US010404001B2

(12) United States Patent
Takahashi

(10) Patent No.: US 10,404,001 B2
(45) Date of Patent: Sep. 3, 2019

(54) CONNECTOR

(71) Applicant: Sumitomo Wiring Systems, Ltd., Yokkaichi, Mie (JP)

(72) Inventor: Kenya Takahashi, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/090,608

(22) PCT Filed: Mar. 27, 2017

(86) PCT No.: PCT/JP2017/012249
§ 371 (c)(1),
(2) Date: Oct. 2, 2018

(87) PCT Pub. No.: WO2017/179406
PCT Pub. Date: Oct. 19, 2017

(65) Prior Publication Data

US 2019/0115680 A1 Apr. 18, 2019

(30) Foreign Application Priority Data

Apr. 11, 2016 (JP) ..... 2016-078698

(51) Int. Cl.
*H01R 13/42* (2006.01)
*H01R 13/56* (2006.01)

(52) U.S. Cl.
CPC ..... *H01R 13/42* (2013.01); *H01R 13/56* (2013.01)

(58) Field of Classification Search
CPC .... H01R 13/56; H01R 13/502; H01R 13/506; H01R 13/5045
See application file for complete search history.

(56) References Cited

U.S. PATENT DOCUMENTS

2015/0147918 A1 5/2015 Matsuda et al.

FOREIGN PATENT DOCUMENTS

| | | |
|---|---|---|
| JP | 2003-45554 | 2/2003 |
| JP | 2011-14364 | 1/2011 |
| JP | 2011-222250 | 11/2011 |
| JP | 2014-53091 | 3/2014 |
| JP | 2015-103377 | 6/2015 |
| JP | 2015-170588 | 9/2015 |
| JP | 2016-006734 | 1/2016 |

OTHER PUBLICATIONS

International Search Report dated Jun. 27, 2017.

*Primary Examiner* — Ross N Gushi
(74) *Attorney, Agent, or Firm* — Gerald E. Hespos; Michael J. Porco; Matthew T. Hespos

(57) ABSTRACT

A connector (10) includes a retainer (30) and a cover (50) to be attached to the retainer (30) from behind. The retainer (30) includes a circular base plate (31), a terminal holding portion (32) penetrating the base plate (31) in a plate thickness direction, a cover attaching portion (34) projecting rearward from a periphery of the base plate (31) and a detecting projection (37) projecting rearward from a rear of the cover attaching portion (34). The cover (50) includes a fitting tube (52) to fit externally to the cover attaching portion (34). A locked portion (54B) holds the fitting tube (52) in a proper attaching posture by being locked to the cover attaching portion (34). A detection hole (57) is open behind the fitting tube (52) and the detecting projection (37) projects out from the detection hole (57) when the fitting tube (52) reaches the proper attaching posture.

5 Claims, 10 Drawing Sheets

CONNECTOR

BACKGROUND

Field of the Invention

This specification relates to a connector.

Related Art

Japanese Unexamined Patent Publication No. 2011-14364 discloses a connector with a connector housing and a wire cover surrounding wires pulled out rearwardly from the connector housing. The wire cover has a hollow cylindrical shape and is fit coaxially to the inner periphery of a rear end part of a first connector housing. Wires connected to rear end parts of female terminal fittings are drawn out from the rear end surface of a housing body are pulled out rearwardly through the wire cover.

However, reliable mounting of the wire cover on the connector housing cannot be confirmed. Further, the wire cover has a hollow cylindrical shape and may rattle in a rotating direction to generate abnormal noise due to vibration during the travel of a vehicle or the like.

SUMMARY

A connector disclosed by this specification includes a retainer, and a cover to be attached to the retainer from behind. The retainer includes a circular base plate and a terminal holding portion penetrates through the base plate in a plate thickness direction. A cover attaching portion projects rearward from a peripheral edge of the base plate and a detecting projection projects rearward from a rear end edge of the cover attaching portion. The cover includes a fitting tube to be fit externally to the cover attaching portion and a locked portion configured to hold the fitting tube in a proper attaching posture by being locked to the cover attaching portion. The cover also has a detection hole that is open behind the fitting tube and that is configured so that the detecting projection is inserted therein to project outward when the fitting tube reaches the proper attaching posture.

According to this configuration, when the retainer is attached to the cover from behind, the detecting projection of the retainer is inserted into the detection hole of the cover and projects outward so that the proper attached posture of the cover on the retainer can be confirmed. Specifically, in a structure for externally fitting the cover to the retainer, a holding portion for holding the cover on the retainer is hidden inside the cover and cannot be confirmed from external appearance. However, according to the above-described configuration, reliable retention of the cover on the retainer can be confirmed from the external appearance even if the holding portion cannot be confirmed.

The detecting projection is locked to an inner wall of the detection hole in a rotating direction of the cover. Thus, the cover cannot rotate and rattle in the rotating direction to generate abnormal noise due to vibration during the travel of a vehicle or the like.

The fitting tube may be at a position radially outward of a cover body that is configured to cover the base plate portion from behind. According to this configuration, the cover body can be formed in accordance with the size of the base plate and need not be enlarged.

The detection hole may penetrate in a front-rear direction through a coupling wall that couples the fitting tube and the cover body. Accordingly, the detection hole utilizes the coupling wall.

The cover attaching portion may extend in a circumferential direction while having an arcuate shape when viewed from behind. A locking projection may project radially inward on an inner peripheral surface of the cover attaching portion, and the locked portion may be locked to the locking projection. According to this configuration, the locking projection is provided on the inner peripheral surface of the cover attaching portion. Thus, the locked portion locked to the locking projection can be protected from external impact and the separation of the locked portion from the locking projection can be avoided.

According to the connector disclosed by this specification, it can be confirmed from external appearance that the cover is held reliably on the retainer. Further, the cover cannot rotate and will not rattle in a rotating direction to generate abnormal noise due to vibration during the travel of a vehicle or the like.

DETAILED DESCRIPTION

Figure 1:
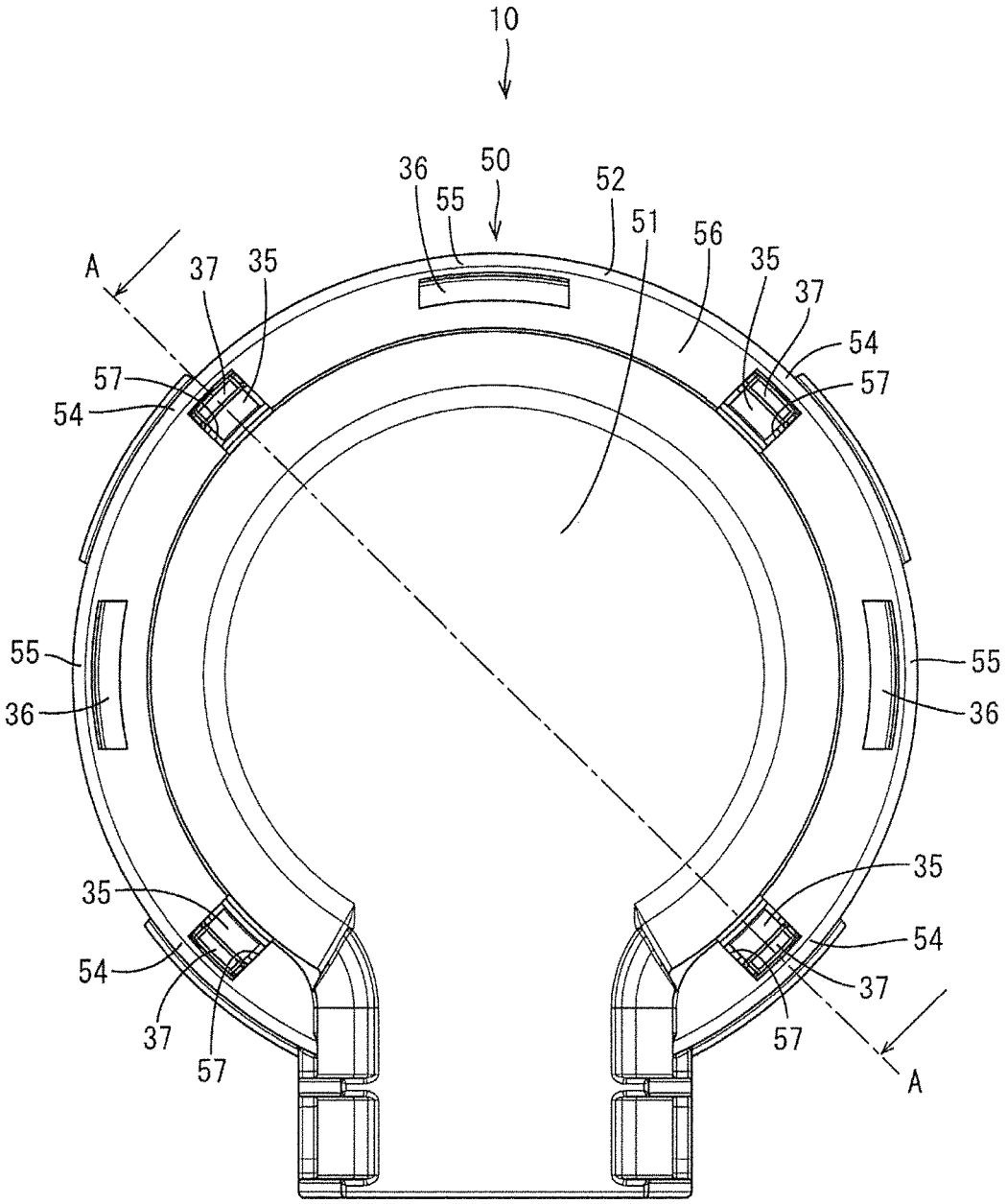
FIG. 1 is a back view of a connector.
Figure 2:
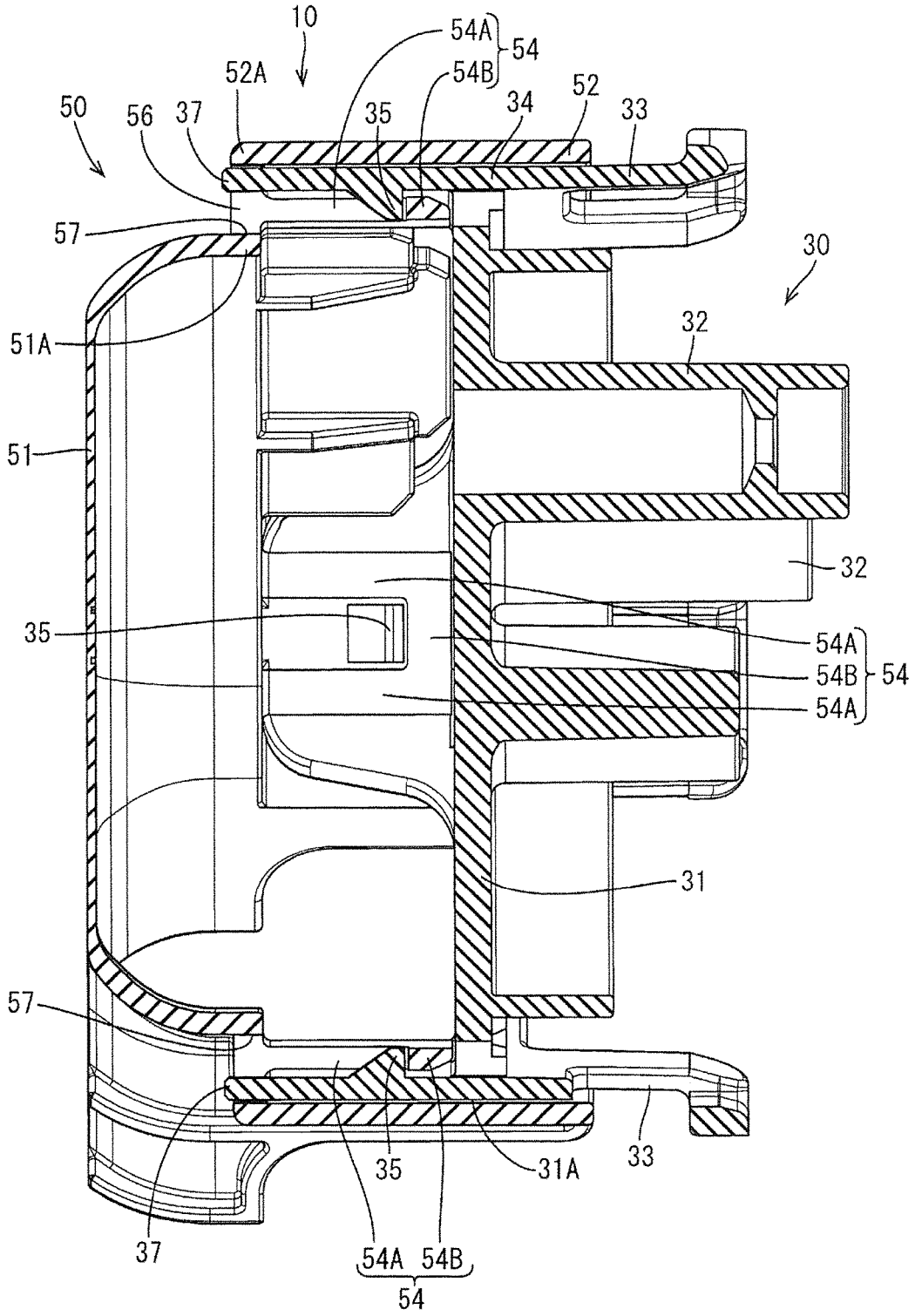
FIG. 2 is a section along A-A in FIG. 1.
Figure 3:
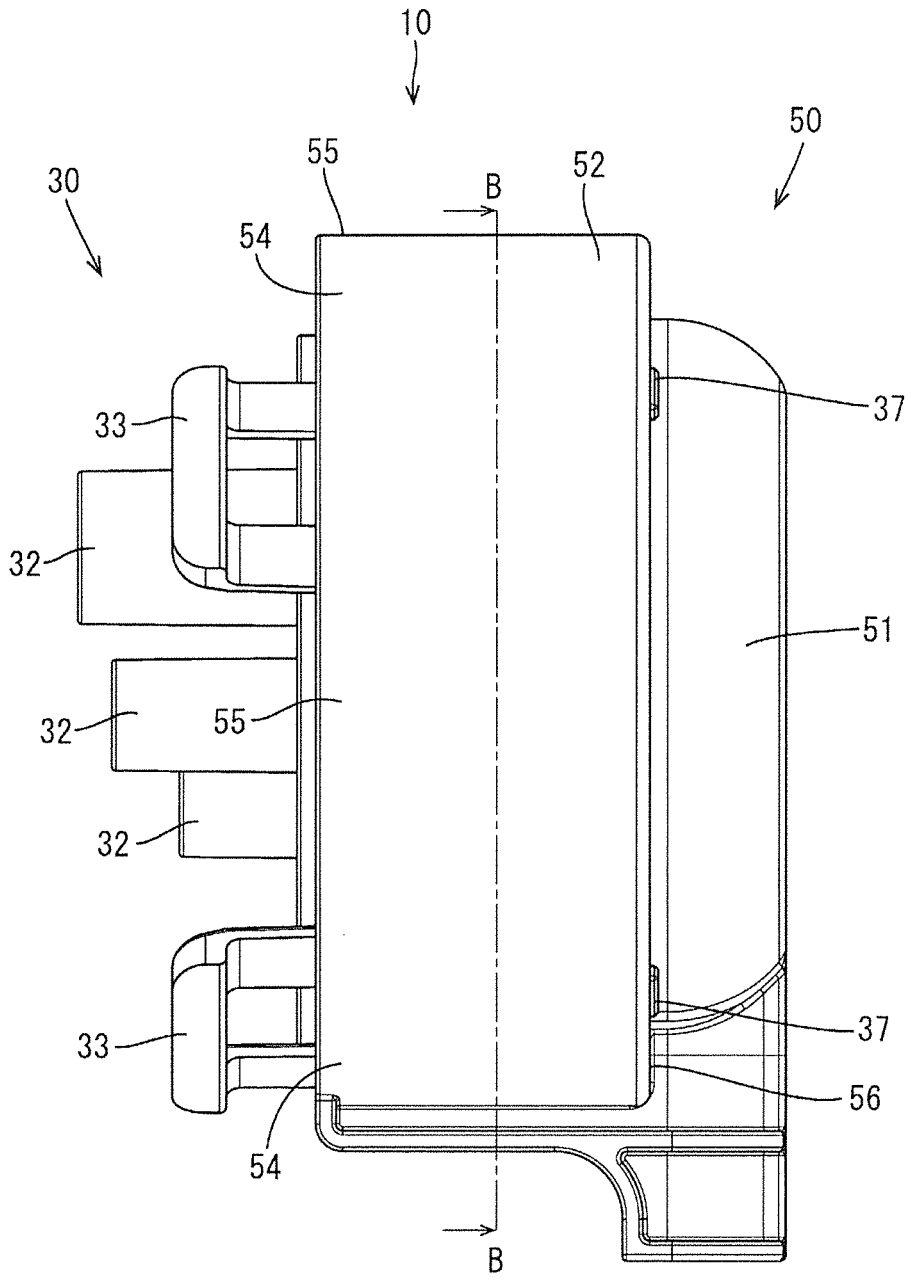
FIG. 3 is a side view of the connector.
Figure 4:
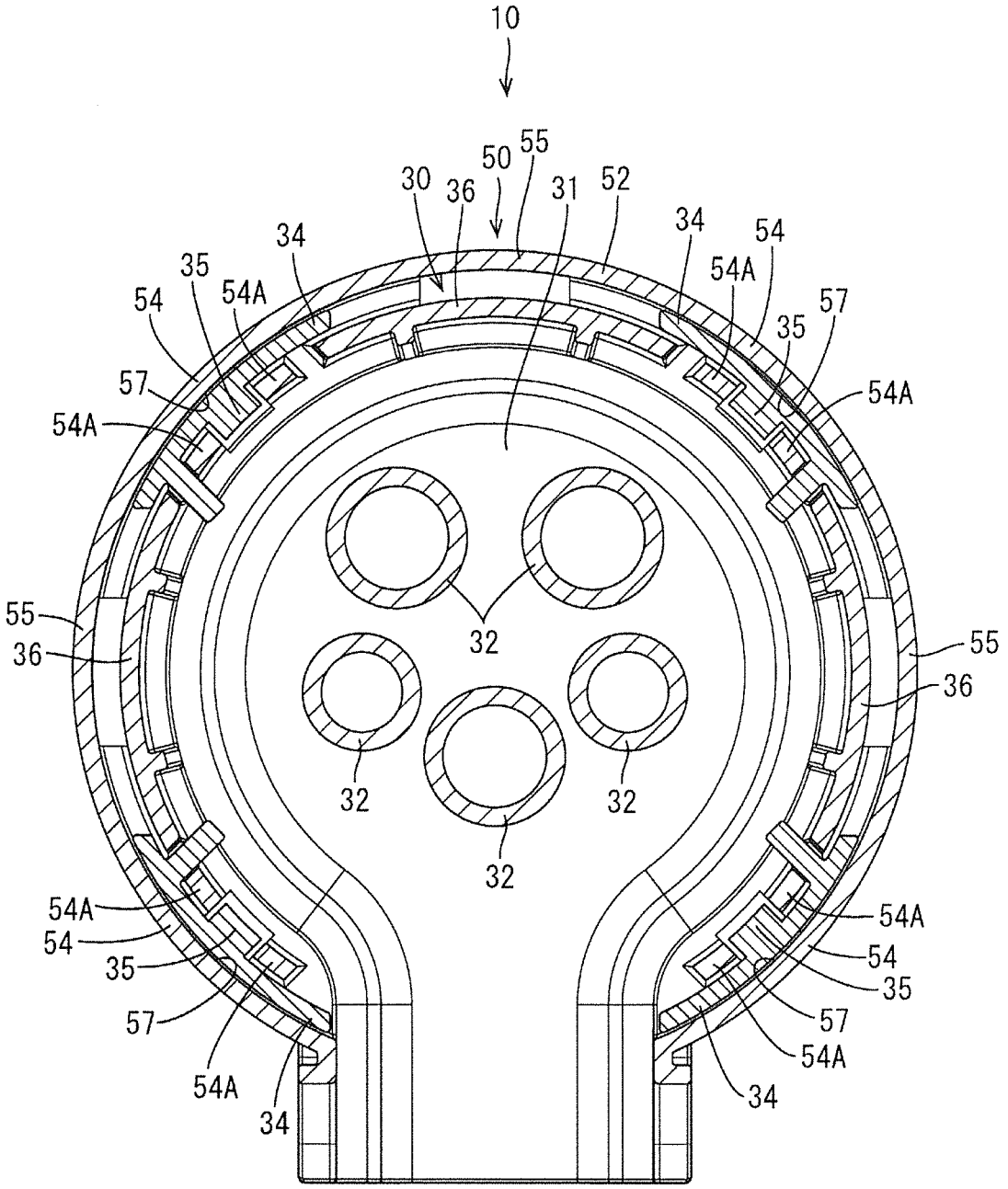
FIG. 4 is a section along B-B in FIG. 3.

An embodiment is described with reference to FIGS. 1 to 10. As shown in FIG. 3, a connector 10 of this embodiment includes a retainer 30 for retaining unillustrated terminals by being attached to an unillustrated housing and a cover 50 for protecting unillustrated wires pulled out from the housing. The retainer 30 is attached to the housing from behind, and the cover 50 is attached to the retainer 30 from behind. The terminals, such as power terminals and signal terminals, are accommodated in the housing, and wires connected to these terminals are pulled out rearward from the housing.

Figure 5:
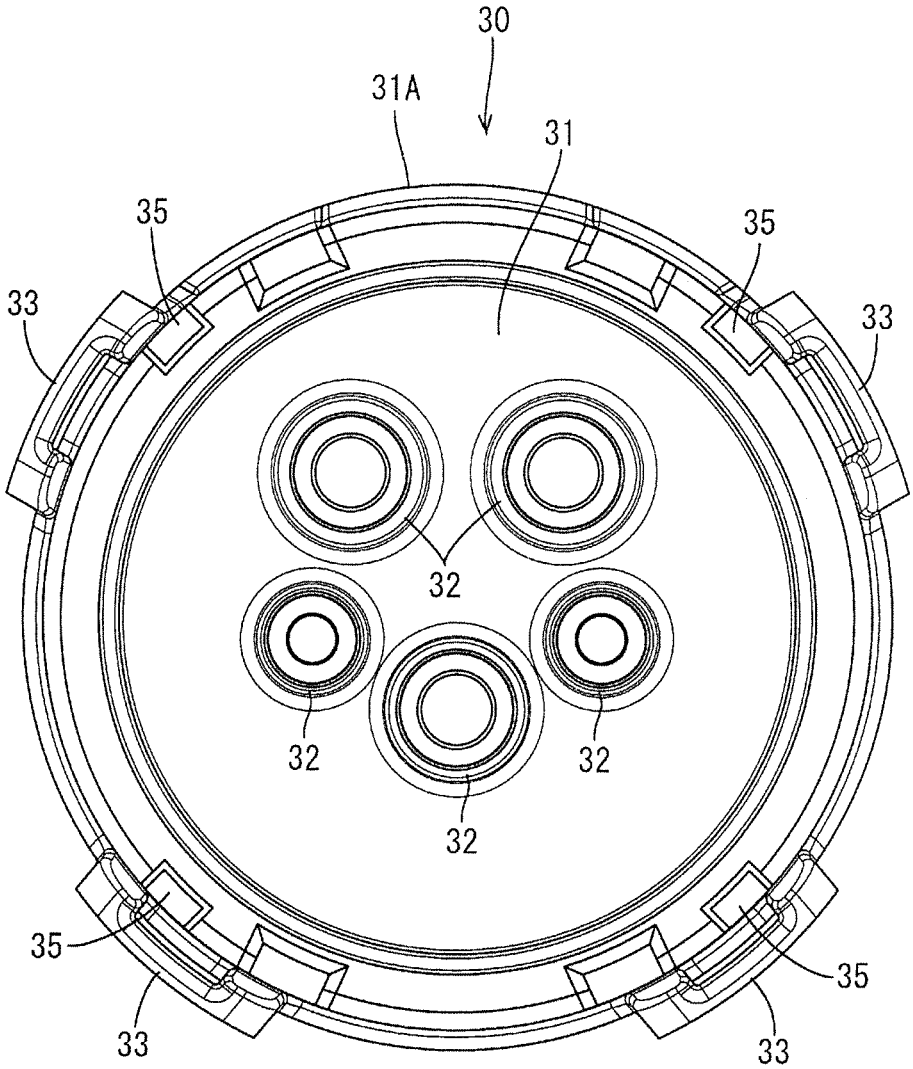
FIG. 5 is a front view of a retainer.
Figure 6:
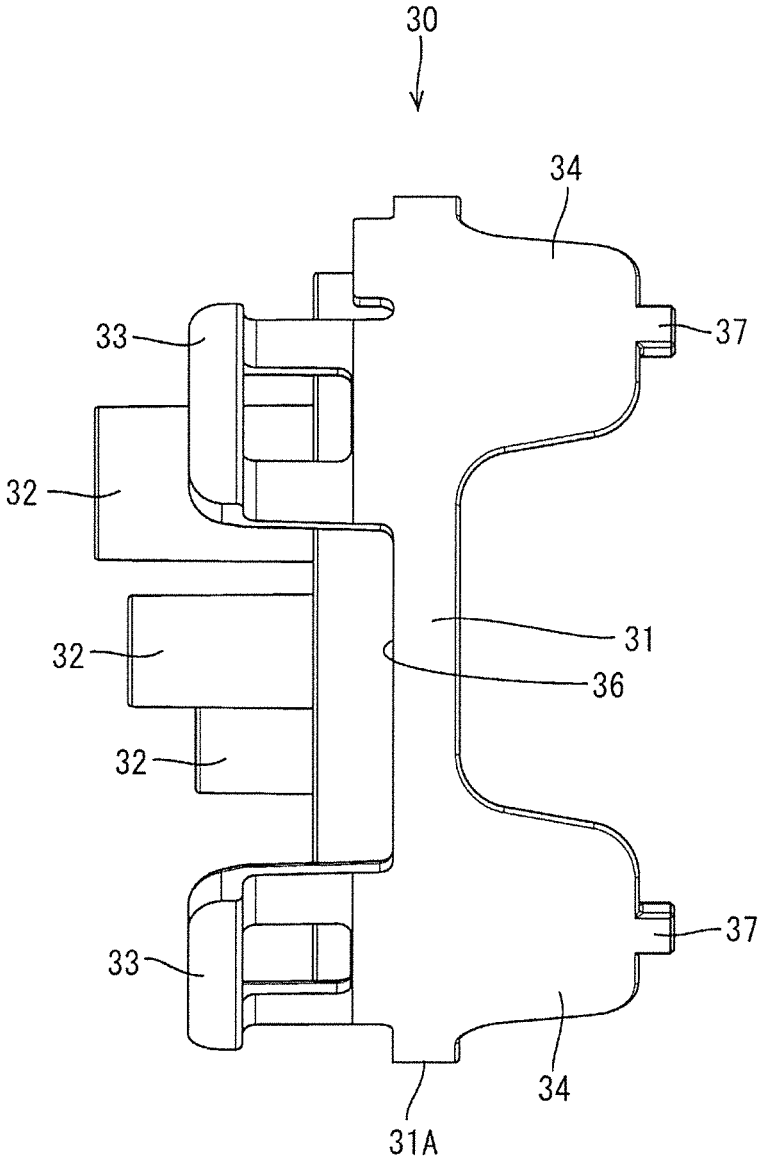
FIG. 6 is a side view of the retainer.
Figure 7:
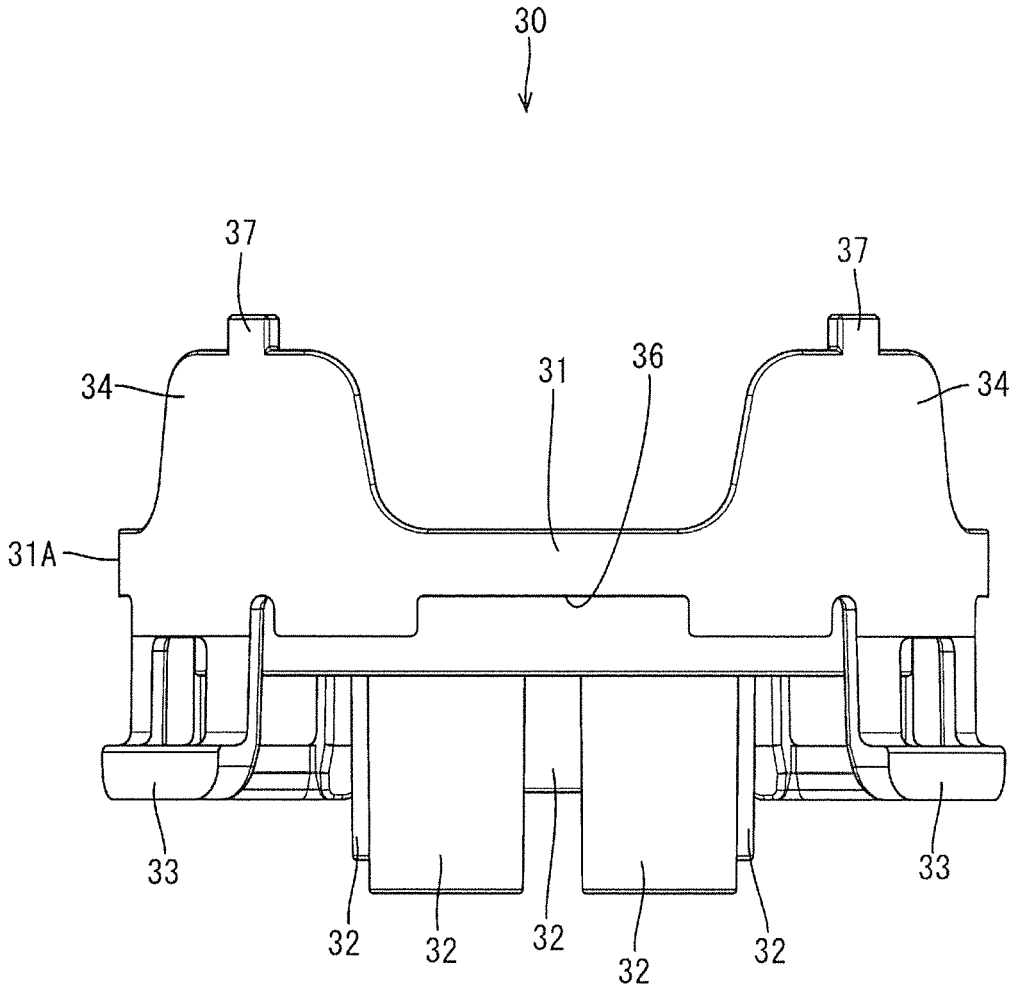
FIG. 7 is a plan view of the retainer.

The retainer 30 is made of synthetic resin and, as shown in FIGS. 5 to 7, includes: a circular and plate-like base plate 31, terminal holding portions 32 that penetrate through the base plate 31 in a plate thickness direction, retainer mounting pieces 33 that project forward from the peripheral edge of the base plate 31, and attaching portions 34 that project rearward from the peripheral edge of the base plate 31. The retainer mounting pieces 33 and the cover attaching portions 34 extend arcuately along an outer peripheral surface 31A of the base plate 31.

The terminal holding portion 32 has a hollow cylindrical shape and can contact a flange provided on the outer periphery of the terminal from behind. In this way, the terminal holding portions 32 hold the respective terminals in the housing. Further, the retainer mounting pieces 33 are resiliently deflectable. Thus, the retainer mounting pieces 33 ride on the projections as the retainer 30 is attached to the housing from behind and then resiliently return to lock projections on the housing when the retainer 30 reaches a proper attaching position.

As shown in FIG. 6, the cover attaching portions 34 extend rearward while being flush with the outer peripheral surface 31A of the base plate 31. Specifically, the cover attaching portions 34 extend in a circumferential direction and have an arcuate shape when viewed from behind. Further, the respective cover attaching portions 34 are at positions substantially corresponding to the respective retainer mounting pieces 33 in a front-rear direction. As shown in FIG. 2, locking projections 35 project radially inward on the inner peripheral surfaces of the cover attaching portions 34.

Figure 8:
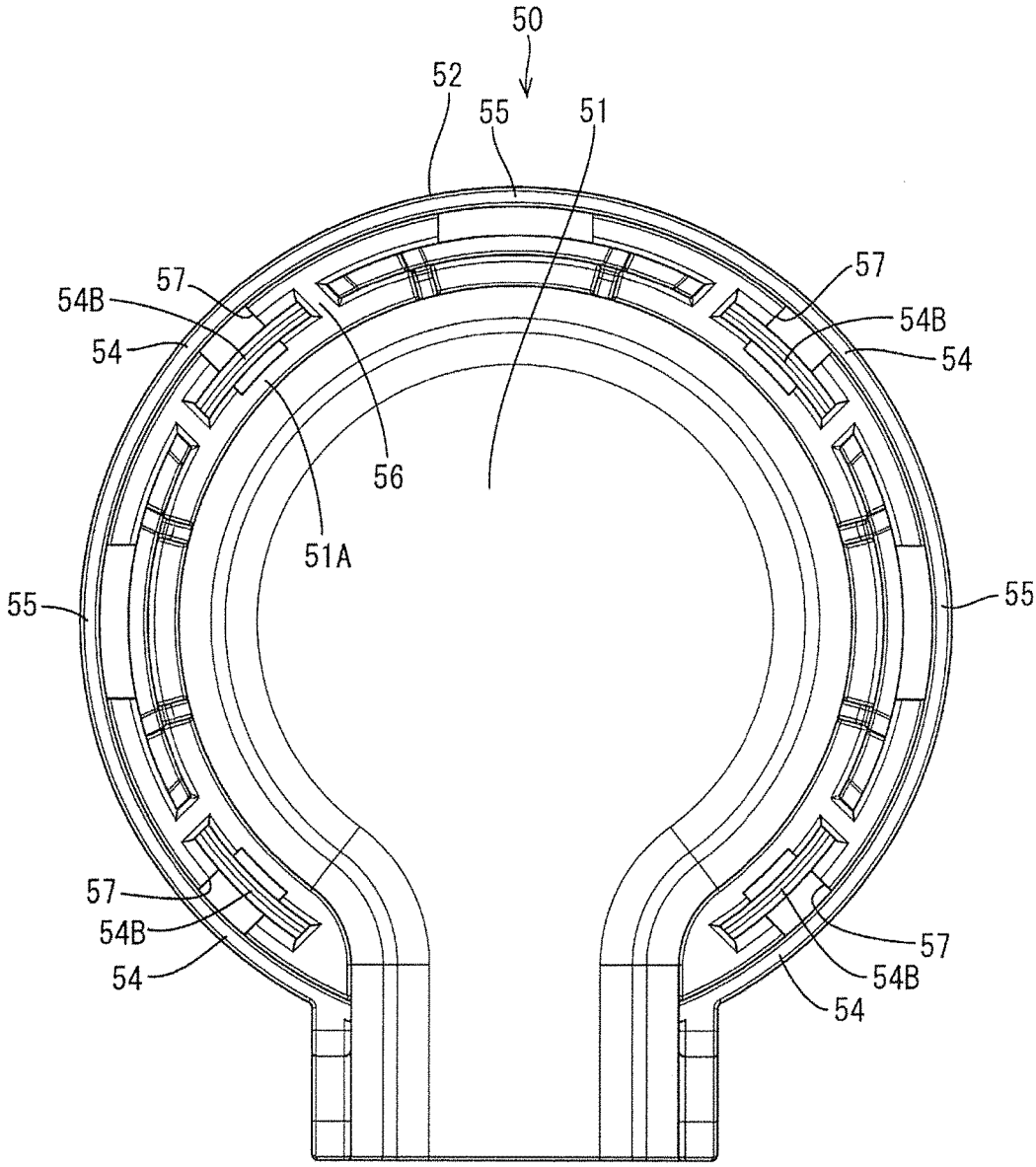
FIG. 8 is a front view of a cover.
Figure 9:
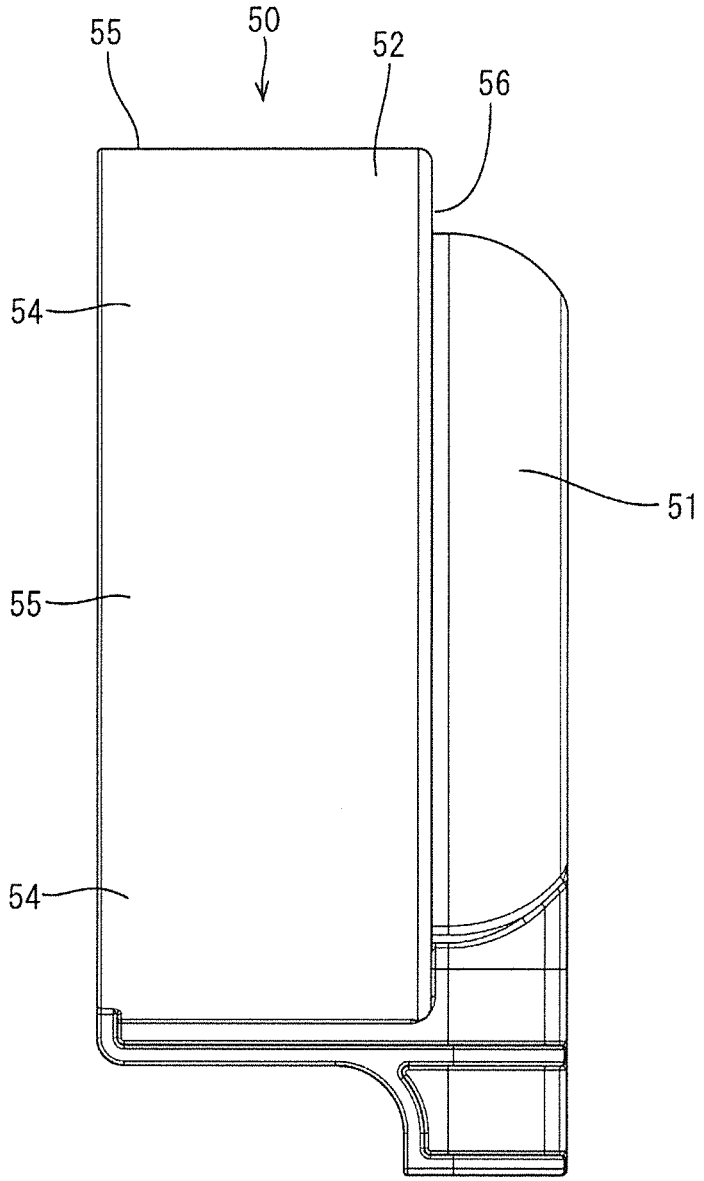
FIG. 9 is a side view of the cover.
Figure 10:
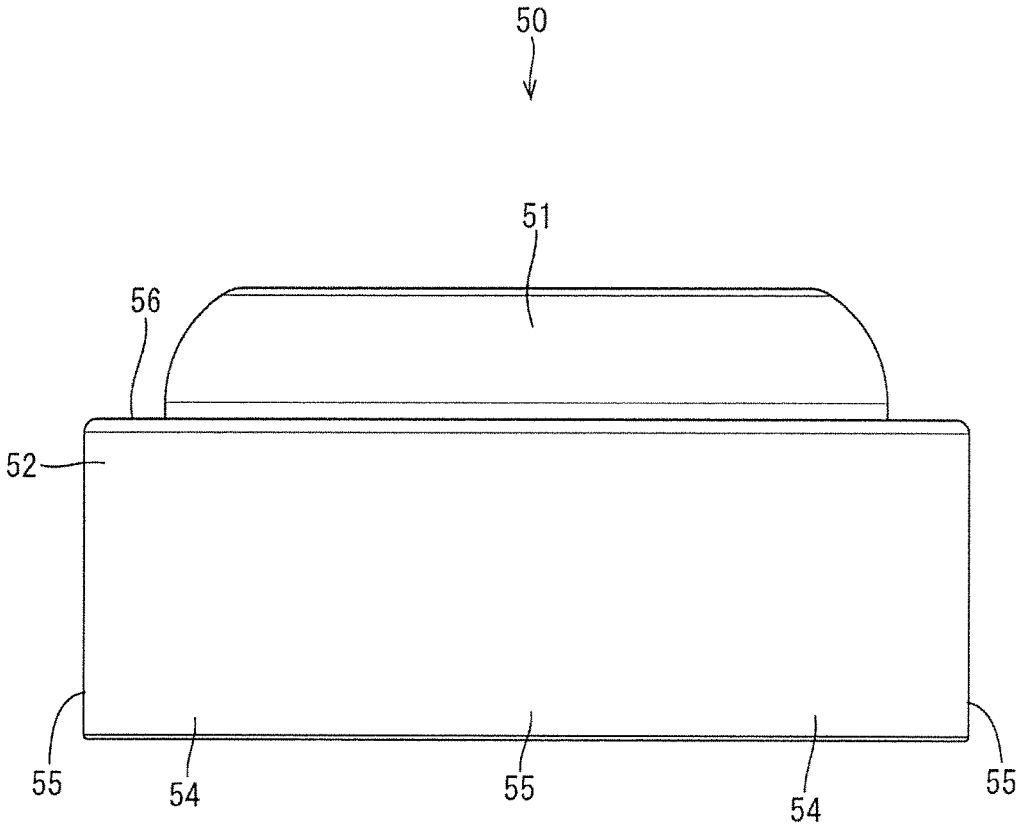
FIG. 10 is a plan view of the cover.

The cover 50 is made of synthetic resin and includes, as shown in FIGS. 8 to 10, a cover body 51 configured to cover wires along a wire routing path and a fitting tube 52 to be fit externally on the respective cover attaching portions 34 of the retainer 30. The fitting tube 52 has inner locks 54 and outer locks 55. The inner and outer locks 54, 55 are disposed alternately side by side in the circumferential direction, and the inner locks 54 are locked to the locking projections 35 described above. Further, the cover attaching portions 34 of the retainer 30 are protected by being covered by the inner lock portions 54.

On the other hand, the outer locks 55 include inward projecting projections although not described in detail. These projections are locked to outer lock receiving portions 36 shown in FIG. 7 from the front to hold the cover 50 on the retainer 30. For example, if the cover 50 is inclined and the inner lock 54 is going to be disengaged from the locking projection 35, such as when the wires are shaken, the outer lock 55 approaches the outer lock receiving portion 36 and an engagement margin between the outer lock 55 and the outer lock receiving portion 36 is not reduced. Thus, the cover 50 is not easily detached from the retainer 30.

As shown in FIG. 2, the inner lock 54 includes locking pieces 54A disposed radially inward of the cover attaching portion 34 and a locked portion 54B to be locked to the locking projection 35. The fitting tube 52 is at a position radially outward of an opening edge 51A of the cover body 51 for covering the base plate 31 from behind, and the opening edge 51A of the cover body 51 and a rear end part 52A of the fitting tube 52 are coupled to each other by a ring-shaped coupling wall 56. The two locking pieces 54A are cantilevered forward from this coupling wall 56 while be arranged in parallel, and front end parts of the locking pieces 54A are coupled by the locked portion 54B. The locked portions 54B are locked to the locking projections 35 of the cover attaching portions 34 from the front to hold the cover 50 on the retainer 30.

In this embodiment, as shown in FIGS. 5 and 6, detecting projections 37 project rearward from the rear end edges of the respective cover attaching portions 34. On the other hand, as shown in FIG. 8, detection holes 57 penetrate through the coupling wall 56 of the cover 50 in the front-rear direction (plate thickness direction of the base plate 31). The detection holes 57 are at positions corresponding to the respective detecting projections 37 and between the opening edge 51A of the cover body 51 and the rear end 52A of the fitting tube 52. When the cover 50 is attached in a proper attaching posture to the retainer 30, the detecting projections 37 pass through the respective detection holes 57 and only tip parts of the respective detecting projections 37 project out from the detection holes 57. In this state, both the inner locks 54 and the outer locks 55 are hidden inside the cover 50 and a locking state cannot be directly visually confirmed. However, the tips of the detecting projections 37 can be seen and this visible detection confirms that the cover 50 is held reliably on the retainer 30.

Further, if a force is applied to the cover 50 in a rotating direction, the locking pieces 54A constituting the inner locks 54 of the retainer 30 contact the locking projections 35 and suppress rotation. However, the locking pieces 54A are cantilevered and deflect in the rotating direction of the cover 50. Thus, the locking pieces alone cannot completely stop rotation of the cover 50. Accordingly, inner walls of the detection holes 57 contact the detecting projections 37 and further suppress the rotation of the cover 50.

Of course, clearances are set between the detecting projections 37 and the inner walls of the detection holes 57 in view of tolerances at the time of assembling. Thus, the rotation of the cover 50 is allowed by as much as these clearances. However, the detecting projections 37 are not deflected or deformed. Thus, the rotation of the cover 50 can be suppressed even though the locking pieces 54A are deflected and deformed. In this way, the generation of abnormal noise due to vibration during the travel of the vehicle or the like is prevented more easily prevented.

As described above, the detecting projections 37 of the retainer 30 are inserted into the detection holes 57 of the cover 50 and project outward when the cover 50 is attached to the retainer 30 from behind. Thus, a proper attachment posture of the cover 50 to the retainer 30 can be confirmed. Specifically, holding portions for holding the cover 50 on the retainer 30 are hidden inside the cover 50 and cannot be confirmed from external appearance. However, this embodiment, enables the external appearance to provide a visible confirmation that the cover 50 is held reliably on the retainer 30 even if the holding portions cannot be confirmed.

Further, the detecting projections 37 are locked to the inner walls of the detection holes 57 in the rotating direction of the cover 50. Thus, the rotation of the cover 50 can be prevented, and the cover 50 will rattle in the rotating direction to generate abnormal noise due to vibration during the travel of the vehicle or the like.

The fitting tube 52 may be provided at the position radially outward of the cover body 51 for covering the base plate 31 from behind. According to this configuration, the cover body 51 can be formed in accordance with the size of the base plate 31. Thus, the enlargement of the cover body 51 can be avoided.

The detection holes 57 may penetrate in the front-rear direction through the coupling wall 56 that couples the fitting tube 52 and the cover body 51. According to this configuration, the detection holes 57 efficiently utilize the coupling wall 56.

The cover attaching portions 34 may extend in the circumferential direction while having an arcuate shape when viewed from behind. Additionally, the locking projections 35 may project radially inward on the inner peripheral surfaces of the cover attaching portions 34, and the locked portions 54B may be locked to the locking projections 35. According to this configuration, the locking projections 35 are on the inner peripheral surfaces of the cover attaching portions 34. Thus, the locked portions 54B locked to the locking projections 35 can be protected from external impact and the separation of the locked portions 54B from the locking projections 35 can be avoided.

The invention is not limited to the above described and illustrated embodiment. For example, the following various modes also are included.

Although the plurality of detecting projections 37 are inserted into the detection holes 57 in the above embodiment, one detecting projection and one detection hole may be provided.

The fitting tube 52 is provided at the position radially outward of the cover body 51 in the above embodiment. However, a fitting tube may extend rearward from the opening edge part 51A of the cover body 51 and may have the same diameter as the opening edge part 51A.

Although the coupling wall 56 is provided with the detection holes 57 in the above embodiment, the cover body 51 may be provided with detection holes if no coupling wall is provided.

The coupling wall 56 is provided with the locked portions 54B in the above embodiment. However, the cover body 51 may be provided with locked portions if no coupling wall is provided.

LIST OF REFERENCE SIGNS

10 . . . connector
30 . . . retainer
31 . . . base plate
32 . . . terminal holding portion
34 . . . cover attaching portion
35 . . . locking projection
37 . . . detecting projection
50 . . . cover
51 . . . cover body
52 . . . fitting tube
54B . . . locked portion
56 . . . coupling wall
57 . . . detection hole

The invention claimed is:

1. A connector, comprising:

a retainer; and a cover to be attached to the retainer from behind;

wherein:

the retainer includes a circular base plate, a terminal holding portion penetrating through the base plate in a plate thickness direction, a cover attaching portion provided projecting rearward from a peripheral edge of the base plate and a detecting projection projecting rearward from a rear end edge of the cover attaching portion; and the cover includes a fitting tube to be fit externally to the cover attaching portion, a locked portion configured to hold the fitting tube in a proper attaching posture by being locked to the cover attaching portion, and a detection hole open behind the fitting tube and configured such that the detecting projection is inserted therein to project outward when the fitting tube reaches the proper attaching posture.

2. The connector of claim 1, wherein the fitting tube is at a position radially outward of a cover body that is configured to cover the base plate from behind.

3. The connector of claim 2, wherein the detection hole penetrates in a front-rear direction through a coupling wall that couples the fitting tube and the cover body.

4. The connector of claim 3, wherein the cover attaching portion extends in a circumferential direction while having an arcuate shape when viewed from behind, a locking projection projects radially inward on an inner peripheral surface of the cover attaching portion, and the locked portion is locked to the locking projection.

5. The connector of claim 1, wherein the cover attaching portion extends in a circumferential direction while having an arcuate shape when viewed from behind, a locking projection projects radially inward on an inner peripheral surface of the cover attaching portion, and the locked portion is locked to the locking projection.

* * * * *